United States Patent [19]

Zwicker et al.

[11] Patent Number: 4,773,095

[45] Date of Patent: Sep. 20, 1988

[54] HEARING AID WITH LOCATING MICROPHONES

[75] Inventors: Eberhard Zwicker, Icking; Thomas Beckenbauer, Munich, both of Fed. Rep. of Germany

[73] Assignee: Siemens Aktiengesellschaft, Berlin & Munich, Fed. Rep. of Germany

[21] Appl. No.: 918,469

[22] Filed: Oct. 14, 1986

[30] Foreign Application Priority Data

Oct. 16, 1985 [DE] Fed. Rep. of Germany ..... 3536915

[51] Int. Cl.[4] ..... H04R 25/00; H04R 1/32; H04R 1/40

[52] U.S. Cl. ..... 381/68.1; 381/68.5

[58] Field of Search ..... 38/68.1, 68.5, 68

[56] References Cited

U.S. PATENT DOCUMENTS

| | | | |
|---|---|---|---|
| 3,247,330 | 4/1966 | Hinman | 381/68.5 |
| 3,458,668 | 7/1969 | Hassler | 381/68.1 |
| 3,789,163 | 1/1974 | Dunlavy | 381/68.5 |
| 3,835,263 | 9/1974 | Killon | 381/68.1 |
| 4,052,571 | 10/1977 | Gregory et al. | 381/68.4 |
| 4,451,709 | 5/1984 | Waxman | 381/68.5 |
| 4,622,440 | 11/1986 | Slavin | 381/68 |

FOREIGN PATENT DOCUMENTS

| | | | |
|---|---|---|---|
| 1272377 | 7/1968 | Fed. Rep. of Germany | 381/68.5 |
| 687614 | 6/1964 | Canada | 381/68.5 |
| 687614 | 6/1964 | Canada | 381/68.5 |
| 2362874 | 6/1974 | Fed. Rep. of Germany | 381/68.5 |
| 2323437 | 11/1974 | Fed. Rep. of Germany | 381/68.1 |
| 2340894 | 2/1975 | Fed. Rep. of Germany | 381/68.1 |
| 2344554 | 3/1975 | Fed. Rep. of Germany | 381/68.1 |
| 2361595 | 6/1975 | Fed. Rep. of Germany | 381/68.1 |
| 3519445 | 2/1986 | Fed. Rep. of Germany | 381/68.5 |
| 687614 | 6/1964 | Canada | 381/68.5 |
| 975891 | 11/1964 | United Kingdom | 381/68.5 |

OTHER PUBLICATIONS

Davis, Hallowell. "Hearing and Deafness, A Guide for Laymen", Murray Hill Books, New York 1947, pp. 183–185.

*Primary Examiner*—Jin F. Ng
*Assistant Examiner*—Danita R. Byrd
*Attorney, Agent, or Firm*—Hill, Van Santen, Steadman & Simpson

[57] ABSTRACT

A hearing aid which can be built into a frame, such as eyeglasses, to be worn by a hearing-impaired person has a first microphone arrangement having a directional reception pattern, and a second microphone arrangement for sound locating. The second microphone arrangement includes a first locating microphone disposed in the region of one ear of the hearing-impaired person, and a second locating microphone disposed in the region of the other ear. The signal from both locating microphones are mixed by a low-pass filter with the signal from the microphone arrangement having a directional reception pattern, and the output of the mixing operation is supplied in common to both ears of the hearing-impaired person.

4 Claims, 2 Drawing Sheets

HEARING AID WITH LOCATING MICROPHONES

BACKGROUND OF THE INVENTION

1. Field of the Invention

The present invention relates to a hearing aid for hearing-impaired persons having a first microphone arrangement with directional characteristics, and a second microphone arrangement.

2. Description of the Prior Art

A hearing aid having first and second microphone arrangements is described in German OS No. 22 22 543. This hearing aid includes a first microphone arrangement having a directional reception pattern consisting of two microphones disposed at the wrist of a hearing-impaired person such that the respective directions of maximum signal reception of the two microphones are parallel to each other, preferably in the direction of an extended finger. This hearing aid also includes a second microphone arrangement consisting of a single microphone for omni-directional reception which is secured to the wrist between the two microphones of the directional microphone arrangement. The second microphone arrangement is disposed such that its reception direction is predominately perpendicular to the surface of the hand. A switching element permits the hearing-impaired person to switch between the general omni-directional reception and reception from a preferred direction. The microphone for omni-directional reception can also be utilized in combination with the earpiece of a telephone apparatus.

A hearing aid having two frontal microphones and two side microphones disposed in the proximity of the ears of a user is described in U.S. Pat. No. 3,789,163. The frontal microphones are not directional microphones. The microphones disposed in the proximity of the ears simply function to increase the sensitivity of the overall microphone arrangement at the sides for improving three-dimensional hearing. This system could not be used, for example, with the omni-directional microphones of German OS No. 22 22 543 because if such microphones were arranged close to the ears of the user in this system the desired directional characteristic of the overall arrangement would be destroyed, particularly in the higher frequency range.

SUMMARY OF THE INVENTION

It is an object of the present invention to provide a hearing aid which provides the sensation of three-dimensional orientation to the user without destroying the directional characteristic of the directional microphone arrangement.

The above object is achieved in a hearing aid constructed in accordance with the principles of the present invention wherein a frame such as eyeglasses wearable by a hearing-impaired person has a first microphone arrangement with a directional reception pattern and a second microphone arrangement, the second microphone arrangement consisting of a first locating microphone disposed in the region of one ear of the user, and a second locating microphone disposed in the region of the other ear. The signals from both locating microphones are mixed with the signal of the directional microphone arrangement by a low-pass filter, and the result of the mixing is supplied in common to both ears of the hearing-impaired person.

In accordance with the invention disclosed herein, a hearing-impaired person can very quickly identify the direction from which audio information of interest is arriving, and can even do so from among a mixture of surrounding sound sources. The sound source of interest is identified by the low-pass filtered audio signals supplied by the two locating microphones. In response thereto, the user can turn his or her head to the incident direction of the audio information, and thus automatically align the direction microphone arrangement with the sound source. The directional pattern of the directional microphone arrangement is substantially undisturbed by the low-pass filtered, i.e., low frequency, signals from the locating microphones. In contrast to conventional microphones for omnidirectional reception as described in the aforementioned prior art, the subject matter of the present application permits spatial resolution of sounds by the user. In those conventional systems, in contrast to the hearing aid disclosed herein, the user can identify the direction from which audio information of interest is arriving only by switching from omni-directional reception to directional reception, and then surveying the surrounding space with the assistance of the directional microphone arrangement. This is an involved and time consuming manner for locating signals of interest previously identified by omni-directional reception.

DESCRIPTION OF THE PREFERRED EMBODIMENTS

Figure 3:
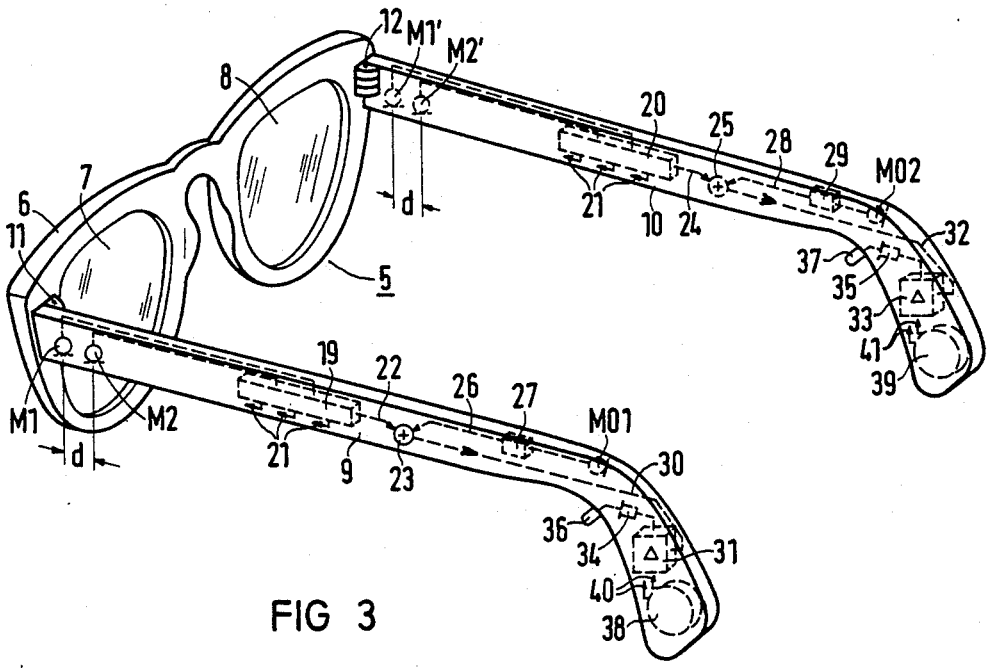
FIG. 3 is a perspective view of the eyeglasses of FIG. 1 showing the details of the hearing aid embodied in the bows of the eyeglasses.

A hearing aid constructed in accordance with the principles of the present invention is shown embodied in an eyeglasses frame 5 worn by a hearing-impaired person 1. The eyeglasses are worn over the left ear 2 and the right ear 3 and the nose 4 of the hearing-impaired person. The eyeglasses frame 5 has a front portion 6 containing lenses 7 and 8, as best seen in FIG. 3. The frame 5 also includes a bow 9 for the left ear 2 and a bow 10 for the right ear 3.

In the bow 9, a first pair of omni-directional microphone buttons M1 and M2 (for example, Knowles microphones) are disposed in the proximity of a hinge 11. A second pair of omnidirectional microphone buttons M1' and M2' are disposed in the other bow 10 in the proximity of a hinge 12. Within both pairs, the omni-directional microphone buttons are mounted at a spacing of, for example, d=5 mm from each other.

Figure 1:
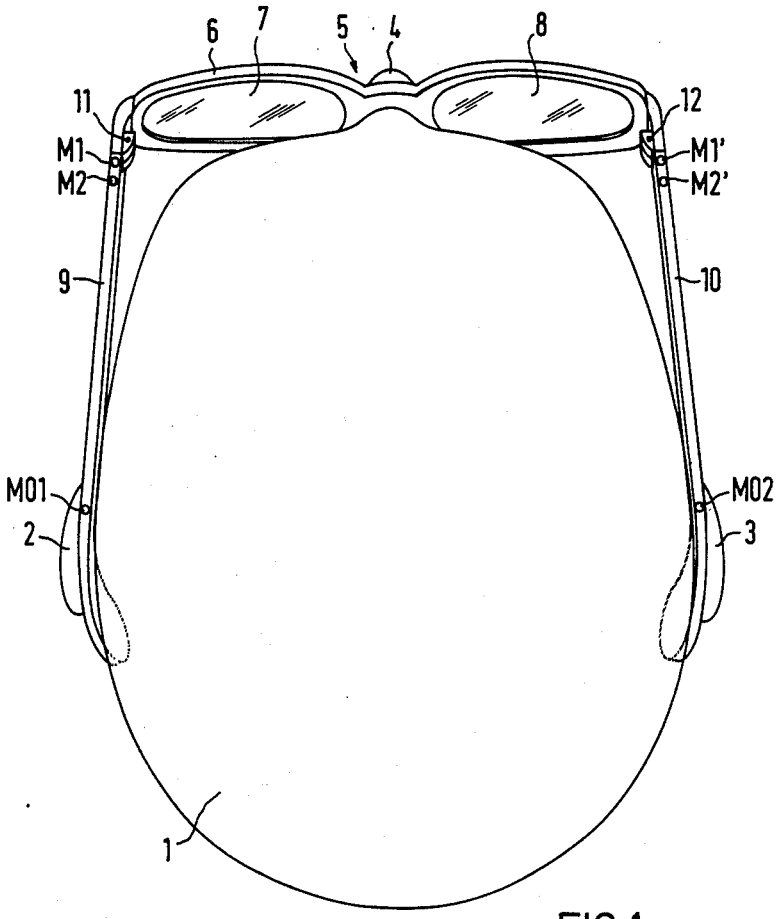
FIG. 1 is a plan view of a hearing aid constructed in accordance with the principles of the present invention embodied in a pair of eyeglasses worn by a hearing-impaired person.
Figure 2:
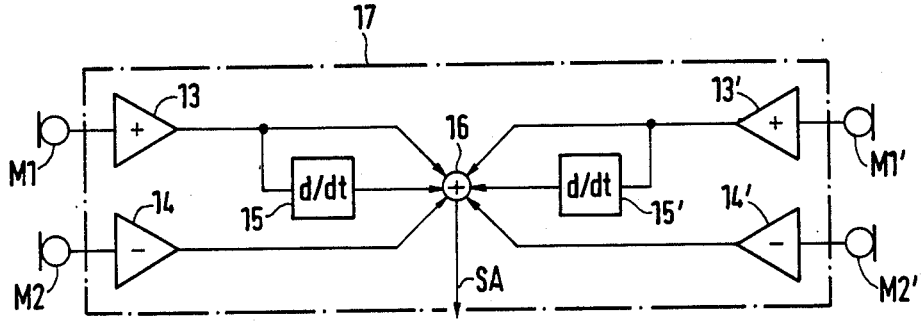
FIG. 2 is a schematic circuit diagram of a directional microphone arrangement suitable for use in the hearing aid disclosed herein.

Each omni-directional microphone button pair forms a directional microphone arrangement as shown in FIG. 2. The components of FIG. 2 are embodied in the bows 9 and 10 of the eyeglasses 5. The outputs of the microphones M1 and M2 are respectively supplied to a non-inverting amplifier 13 and an inverting amplifier 14. One of the outputs of the amplifiers 13 and 14, such as the output of the amplifier 13, is supplied to a differentiating element 15. The outputs of the other pair of microphones M1' and M2' are also respectively supplied to a noninverting amplifier 13' and an inverting amplifier 14', and the output of one of those amplifiers, such as the output of the amplifier 13', is supplied to a differentiating element 15'. The outputs of the amplifiers 13, 14, 13' and 14' as well as the outputs of the differentiating 15 and 15' are supplied to a summing unit 16. The respective outputs are combined in the summing unit 16 to form an output signal SA. As shown in FIG. 2, the components other then the microphones can be contained in a single module 17, or may be divided into modules 19 and 20 as shown in FIG. 3 connected to each other via lines 21. Each of the differentiating elements 15 and 15' has adjustable primary gain. Such a directional microphone arrangement is described in the co-pending application Ser. No. 918,497, now U.S. Pat. No. 4,712,244 of Zwicker, Beckenbauer and Beer filed simultaneously herewith and assigned to the same assignee as the present subject matter. Any other type of suitable directional microphone arrangement may also be utilized.

In accordance with the principles of the present invention, two locating microphones MO1 and MO2 (for example Knowles omni-directional microphones) are also arranged in the respective eyeglasses bows 9 and 10. The first locating microphone MO1 is disposed above the left ear of the user and the second locating microphone MO2 is disposed above the right ear of the user when the eyeglasses 5 are in place. The locating microphones MO1 and MO2 may alternatively be disposed within the external ear of the user. If the microphones are disposed in the region of the ears of the user, the damping effect of the head 1 is greatest, so that an optimum locating effect is achieved. Low frequencies (less then approximately 800 Hz) are particularly useful for locational hearing. The signals of the two locating microphones MO1 and MO2 are therefore preferably mixed by low-pass filters 27 and 29 having a corresponding limit frequency, as shown in greater detail in FIG. 3.

In the embodiment shown in FIG. 3, the components of FIG. 2 are disposed in the eyeglasses 5 in respective modules 19 and 20. As stated above, the modules 19 and 20 are connected by lines 21 which may be conducted through the eyeglasses bows and the front portion 6 or may be connected by some other cable run, the details of which need not be shown in FIG. 3. In the eyeglasses bow 9, the output line for the signal SA (FIG. 2) is connected to an adder element 23 by a branch line 22. In the other eyeglasses bow 10, the output signal SA is supplied via branch line 24 to an adder element 25. The adder element 23 is also supplied via a signal line 26 with the microphone signal from the locating microphone MO1 filtered by the low-pass filter 27. Identically, the adder element 25 in the other eyeglasses bow 10 is supplied with the signal from the locating microphone MO2 via signal line 28 through low-pass filter 29. The output at the adder element 23 is connected to the input of an amplifier 31 by a signal line 30, and the output of the adder element 25 is supplied to the input of an amplifier 33 by a signal line 32. A receiver 34 for the left ear canal of the hearing-impaired person is connected to the output of the amplifier 31. A receiver 35 for the right ear canal of the hearing-impaired person is connected to the output of the amplifier 33.

The receivers 34 and 35 are generally connected to the ear canals by conduit connections and ear olives (not shown). The receivers may, however, alternatively be directly placed within the ear canals as is standard for in-ear hearing aids. In the embodiment of FIG. 3, a conduit connection for the left side is referenced 36 and a conduit connection for the right side is referenced 37. The respective bows 9 and 10 contain batteries 38 and 39 for supplying power to the other components via respective lines 40 and 41.

As discussed above, the two microphones MO1 and MO2 function as locating microphones. When the eyeglasses are worn by a hearing-impaired person, the microphone MO1 lies directly above the left ear of the user, and the microphone MO2 lies directly above the right ear of the user. By means of the two locating microphones MO1 and MO2, the hearing-impaired person can locate a sound source of interest and turn his or her head with the hearing-aid eyeglasses in the direction of this sound source. With the head directed toward the sound source, the directional microphone arrangement consisting of the microphones M1, M2, M1' and M2' can operate fully using the directional reception pattern thereof.

In the exemplary embodiment of FIG. 3, all components including the microphones are accomodated in the eyeglasses bows. These components may alternatively be formed in modules which are externally attached to the bows. It is also possible for those hearing-impaired persons not in need of eyeglasses to mount the microphones and other components on a suitable head clip.

Although modifications and changes may be suggested by those skilled in the art it is the intention of the inventors to embody within the patent warranted hereon all changes and modifications as reasonably and properly come within the scope of their contribution to the art.

We claim as our invention:

1. A hearing aid system for hearing-impaired persons comprising:

a frame wearable on the head of a hearing-impaired person;

a first microphone arrangement mounted on said frame and having a directional reception pattern;

a second microphone arrangement for locating the source of a sound, said second microphone arrangement consisting of first and second locating microphones mounted on said frame such that when said frame is worn by said hearing-impaired person said first locating microphone is disposed in the region of one ear of said hearing-impaired person and said second locating microphone is disposed in the region of the other ear of said person;

two low-pass filters respectively connected to the outputs of said first and second locating microphones;

means combining the output signals from said first microphone arrangement with the outputs of said low-pass filters; and means for supplying the output of said means for combining to both ears of said hearing-impaired person.

2. A hearing aid as claimed in claim 1, wherein said frame is a pair of eyeglasses having two bows, and wherein said first locating microphone is disposed in one of said bows over said one ear and wherein said second locating microphone is disposed in the other of said bows over the other ear.

3. A hearing aid as claimed in claim 1, wherein each of said first and second locating microphones are omnidirectional microphones.

4. A hearing aid to be worn by a hearing-impaired person comprising:

an eyeglass frame having a front lens-containing portion connected by respective hinges to two bows;

a first microphone arrangement having directional reception characteristics consisting of a first microphone pair disposed at a distal end of one of said bows in the proximity of one of said hinges and a second pair of microphones disposed at a distal end of the other of said bows in the proximity of the other of said hinges;

a second microphone arrangement consisting of a locating microphone mounted in said one of said bows so as to be disposed over one ear of said person when said eyeglasses are in place and a second locating microphone mounted in the other of said bows so as to be disposed over the other ear of said person when said eyeglasses are in place;

two low-pass filters respectively disposed in said bows having inputs connected to the outputs of said respective first and second locating microphones;

two mixing means respectively disposed in said bows for respectively combining the outputs of the low-pass filter and the microphone pair disposed in the same bow; and means for supplying the output of said means for mixing to both ears of said hearing-impaired person.

* * * * *